United States Patent [19]

Weisser et al.

[11] Patent Number: 5,034,718

[45] Date of Patent: Jul. 23, 1991

[54] SPARK PROTECTION FOR HIGH VOLTAGE RESISTORS

[75] Inventors: David C. Weisser, Kambah; Alan K. Cooper, Lyons; Alistair G. Muirhead, Mawson; Howard J. Wallace, Kaleen; James D. Stewart, Red Hill; Robert B. Turkentine, Giralang, all of Australia

[73] Assignee: Australian National University, Australian Capital Territory, Australia

[21] Appl. No.: 418,676

[22] Filed: Oct. 10, 1989

[30] Foreign Application Priority Data

Oct. 10, 1988 [AU] Australia ..... PJ0847

[51] Int. Cl.[5] ..... H01C 1/06

[52] U.S. Cl. ..... 338/64; 338/315; 338/334

[58] Field of Search ..... 174/61, 62, 63, 64; 313/325, 326, 331; 338/64, 315, 277, 226, 334, 333, 60, 187

[56] References Cited

U.S. PATENT DOCUMENTS 4,862,135 8/1989 Broadhurst ..... 338/64

*Primary Examiner*—Bruce A. Reynolds
*Assistant Examiner*—Marvin M. Lateef
*Attorney, Agent, or Firm*—Harness, Dickey & Pierce

[57] ABSTRACT

Resistors have successfully replaced corona point discharge devices in the control of high voltage gradients, such as those experienced in electrostatic accelerators. An improved resistor for such applications which has a single elongate resistive element, one end of which is mounted on a metal clamp which is adapted to be clamped to the edge of a metal disc of the type used in a supporting column or tube of an electrostatic accelerator. The other (free) end of the resistor is unsupported, but carries a tubular capacitive electrode, which provides, with a cylindrical metal housing which is mounted on the clamp coaxially with the resistive element, a spark gap. The free end of the resistor also supports a light-weight connector, into which or on to which a plug can be inserted or affixed to make an external electrical connection to the resistive element.

7 Claims, 2 Drawing Sheets

SPARK PROTECTION FOR HIGH VOLTAGE RESISTORS

TECHNICAL FIELD

This invention concerns high voltage resistors. More particularly, it concerns resistors and resistor assemblies for use in high voltage dc applications, which require protection from spark damage when voltage surges occur. It is particularly suitable for use with the supporting columns for the high voltage terminal in an electrostatic accelerator, and with the accelerator tube of such an accelerator. However, the use of the present invention is not limited to these applications.

BACKGROUND TO THE INVENTION

Electrostatic accelerators in general, and Pelletron accelerators in particular, and are well known. They have been installed in a number of research establishments throughout the world. Currently, Pelletron electrostatic accelerators are manufactured only by National Electrostatic Corporation (NEC) of Middleton, Wis., USA, and the major manufacturer of Van de Graaf accelerators is High Voltage Engineering Corporation (HVEC), Massachusetts, USA. The Australian National University has a Pelletron accelerator and because the present invention was developed as a consequence of an appreciation of deficiencies in the voltage grading used in that accelerator, this description of the present invention will tend to emphasise its use in a Pelletron accelerator.

In a Pelletron accelerator, a high voltage terminal, which is charged by the movement of charge-carrying pellets mounted in a conveyor type of arrangement, is supported within a large metal high pressure vessel by a plurality of supporting columns. Each supporting column extends from a wall of the pressure vessel (which is at ground potential) to the high voltage terminal and comprises a large number of insulating discs, separated by thinner metallic discs. The vessel is filled with an insulating gas—sulphur hexafluoride—to a pressure of about 6 atmospheres. To ensure that there is no inadvertent sparking within the vessel while the high voltage terminal is being charged (typically to 14 MV) or is being maintained at its charged level, there must be an equal electrical stress on each insulator. To achieve such an equal electrical stress, it is necessary to provide a uniform voltage gradient along the supporting columns.

The high pressure vessel also contains the tube of the accelerator, which is constructed from a large number of annular insulating discs, separated by thinner, annular, metallic discs or flanges. It is normally a requirement that the voltage gradient along the tube of the accelerator should be uniform, although in some cases it is desirable to be able to vary the voltage gradient (for example, to achieve particular beam optics).

Traditionally, the voltage gradient has been controlled by a corona discharge device connected between adjacent metallic discs of the columns and the tube. The corona discharge devices are relatively inexpensive and are robust, but there are some disadvantages associated with the corona voltage grading system.

The major disadvantage of the corona devices is that the voltage across the corona point-to-plane gap depends upon the separation distance, point sharpness, the presence of foreign material and the insulating gas pressure. When corona point discharge devices have been tested after their installation, using a spacer jig, more than 10 per cent of them have shown variations from the mean, in the voltage drop across the devices, of more than 10 per cent. In non-standard installations, such as between accelerator tube flanges, it has been established that more than 50 per cent of the corona point devices exhibit a variation from the mean voltage drop across the devices of more than 10 per cent. Thus over-stressed gaps in the components of the accelerator tube are quite common.

Another major disadvantage in the use of corona devices is that the corona discharge system causes some breakdown of the insulating $SF_6$ gas, and the breakdown products are corrosive. The resultant chemical attack can be reduced to an acceptable level by efficient chemical scrubbing, but scrubbing incurs a significant capital cost to perform.

Most corona discharge devices in electrostatic accelerators need to be replaced at intervals of about two years. Although the replacement of the components in the accelerator involves a cost of only a few thousand dollars, the accelerator has to be shut down for at least two weeks while the replacement is effected. About 60 per cent of the shut down time is directly assignable to corona point replacement. It has been estimated that the true cost of replacement of the corona point devices is approximately $110,000 per year.

The deliberate variation from linear voltage gradient along an accelerator tube, mentioned briefly above, is very awkward to effect with corona point discharge devices.

To overcome the above-noted disadvantages associated with the use of corona point discharge devices, it has been proposed to use resistors in place of the corona discharge devices. There are no $SF_6$ breakdown products when resistors are used, and varying the voltage gradient along an accelerator tube is a trivial operation using resistors. In fact, in some of the accelerators where this change has been made, the benefits have far outweighed the initial high cost of installing resistors in place of the corona point discharge devices. For example, at Daresbury, in the United Kingdom, an electrostatic accelerator incorporating a resistor system has been operated for 10 years without lost time due to resistor failure.

Unfortunately, some problems are experienced when resistors are used in an accelerator. High voltage resistors, by their nature, tend to be long devices. For example, in the HVEC accelerators, the resistors are 50 cm long and grade about 50 KV per gap between conducting plates in a support column or tube. Multiple element resistors in both in-line and serpentine configuration have also been used, but they also span about 50 cm. Such long resistors tend to act as aerials, and the induced charge developed by each "aerial" during a major accelerator discharge can substantially increase the electrical stress imposed upon the resistors.

The obvious solution of using shorter (and therefore thicker) resistors is impractical because, to fit into the space available in most electrostatic accelerators, the resistors must fit within a cylindrical housing having an outer diameter of about 16 mm. Marginally thicker resistors can be used in those accelerators having a higher electrode spacing (pitch) of 25 mm.

A recent development, by the French company Vivirad, is to mount a pair of resistors on each column or tube electrode, in a side-by-side arrangement, with the resistors connected in series by a spring extending between their ends which are remote from the column or tube.

DISCLOSURE OF THE PRESENT INVENTION

It is an object of the present invention to provide a high voltage resistor assembly having a novel arrangement of components, which is relatively short, is adapted to be assembled on the flanges or metal discs of a supporting column or tube of an electrostatic accelerator, has a minimised aerial effect, incorporates a protective housing which can have an outer diameter as small as 18 mm, and has a resistance value which remains stable and accurate to within a small predetermined percentage of the required resistance of the resistor.

This objective is achieved by providing a resistor which has a single elongate resistive element, one end of which is mounted on a metal clamp which is adapted to be clamped to the edge of a metal disc of the type used in a supporting column or tube of an electrostatic accelerator. The other (free) end of the resistor is unsupported, but carries a tubular capacitive electrode, which provides, with a cylindrical metal housing which is mounted on the clamp coaxially with the resistive element, a spark gap. The free end of the resistor also supports a light-weight connector, into which or on to which a plug can be inserted or affixed to make an external electrical connection to the resistive element.

The resistive element of the resistor should be supplied with an accuracy that is suitable for the application in which the resistor is to be used. In the case of electrostatic accelerators, that accuracy is 2 per cent of the nominal value of the resistor. The production of resistive elements to this degree of accuracy is known technology. One company in Britain (Welwyn), for example, makes resistive elements from a resistive film coating a ceramic former, the film being machined along the middle portion of its length to remove a helical strip of the coating. A metal (usually brass) cylinder is pressed into intimate contact with the non-machined ends of the resistive coating, to enable good electrical contact to be made with the ends of the resistive element without distorting the resistive coating. Other resistor manufacturers use different techniques to create the required resistive element and provide cylindrical end caps.

Thus, according to the present invention, a resistor for use in high voltage dc applications comprises:

(a) a metal clamp, adapted to be clamped to the edge portion of a metallic disc or flange used in the high voltage dc application, said metal clamp having a support region of substantially circular cross-section;

(b) a cylindrical metal tube that has been force fitted on to the support region of said metal clamp said metal tube extending from the support region away from the clamping portion thereof;

(c) an elongate resistive element, each end of which is terminated by a metal cap which fits over the end of the resistive material of the resistive element and makes intimate electrical contact with said resistive material, each metal cap having a centrally mounted, externally threaded projection from the end thereof, the projection having an Allen key socket or the like formed centrally therein, one of said metal caps being securely screwed into a receptive threaded aperture in the centre of the support region of said clamp, whereby the resistive element projects from the support region coaxially with said cylindrical tube;

(d) a cylindrical capacitive electrode having an outer diameter less than the inner diameter of said cylindrical tube mounted on the projection from the end of the metal cap of the resistive element which is remote from said support region; said capacitive electrode being coaxial with said resistive element and said cylindrical tube and defining, with said cylindrical tube, a spark gap for said resistor; and (e) a connector also mounted on the end of said resistive element which is remote from said support region, said connector being mounted adjacent to said capacitive electrode.

The present invention also encompasses a system of attachment of pairs of resistors, constructed in accordance with the present invention, between adjacent metal discs of an accelerator support column or tube.

Embodiments of the present invention will now be described, by way of example only, with reference to the accompanying drawings.

DETAILED DESCRIPTION OF THE ILLUSTRATED EMBODIMENTS

Figure 1:
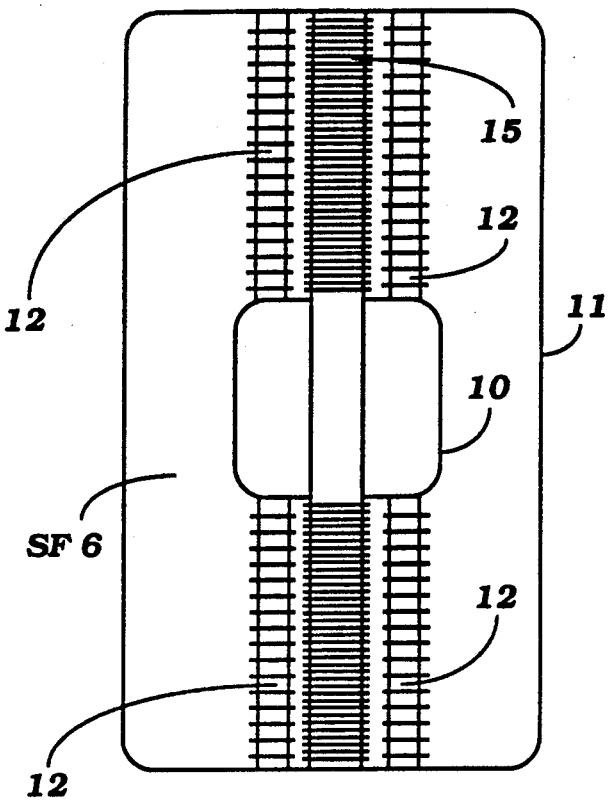
FIG. 1 is a schematic view of a Pelletron accelerator.

The Pelletron accelerator shown schematically in FIG. 1 has a high voltage terminal 10 supported within a metal pressure vessel 11 by a plurality of columns 12. A tube 15 is mounted within the pressure vessel. The "conveyor" of charged, insulated, metallic pellets, which passes from a charging region to the high voltage terminal 10, is not shown in this drawing. The interior of the tube 15 is maintained at low pressure. The vessel 11 is filled with sulphur hexafluoride gas at a pressure of about 6 atmospheres. The operation of this type of accelerator is well known to those skilled in this art.

Figure 2:
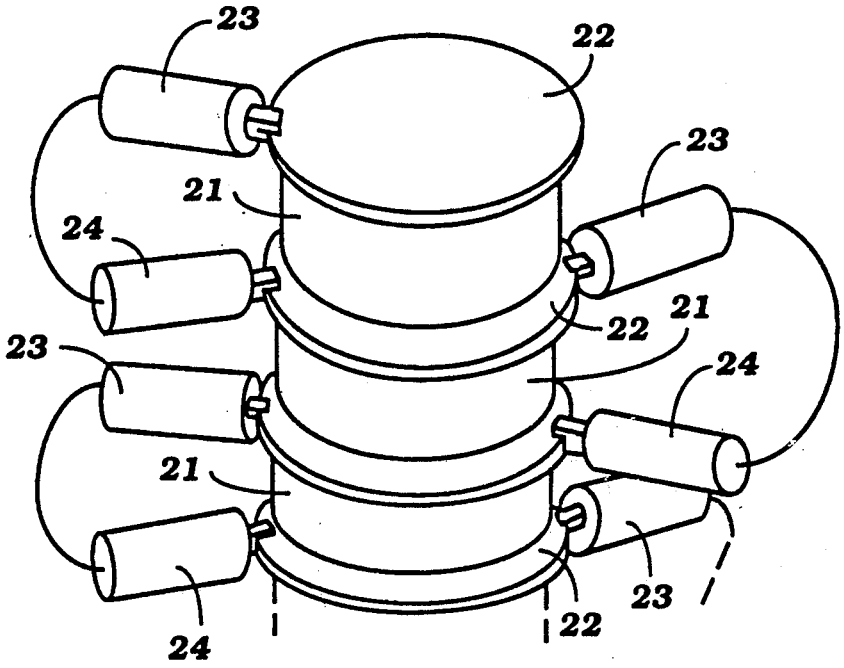
FIG. 2 illustrates the construction of support columns and the tube of an electrostatic accelerator, with resistors attached to the metal discs thereof.

As shown in FIG. 2, each of the columns 12 comprises a series of solid insulating discs 21 separated by thin metal discs 22. Each column has several hundred such pairs of insulating and metal discs. As is well known, the tube 15 of the linear accelerator is constructed in the same manner, except that the insulating and metal discs are annular discs.

When resistors are used in accordance with the present invention to provide a uniform (or a required) voltage gradient along a supporting column or tube of the accelerator, the resistors are mounted as shown in FIG. 2. Each resistor 23 is connected in series with another resistor 24, and the pair of resistors provides the electrical interconnection of adjacent metal discs 22. The respective connections at the clamps of a pair of resistors to the discs 22 are typically about 1 cm apart in their locations on the circumferences of the adjacent discs. The pairs of resistors are mounted alternately on opposite sides of the column or tube, to minimise the possibility of sparking between adjacent pairs of resistor protective tubes.

Figure 6:
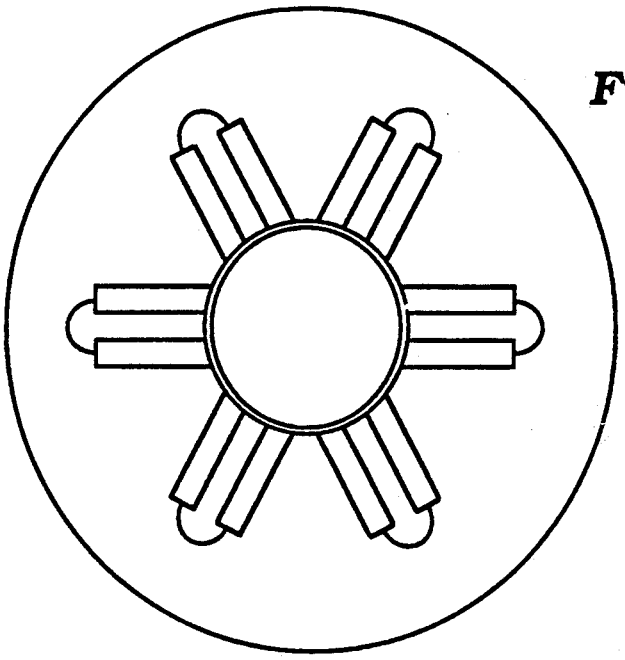
FIG. 6 illustrates a preferred arrangement for connecting resistors to the accelerator tube of an electrostatic accelerator.

When used in connection with an accelerator tube, the resistor pairs may be sequentially staggered around the tube, to produce a helical array of resistor pairs, as shown in FIG. 6. However, there is substantial flexibility in the way in which the array of resistor pairs may be arranged to bridge the adjacent metal discs of a support column. For example, the resistor assemblies may be mounted tangentially to the tube electrodes to maximise the clearance between the connecting loops (which join the unclamped ends of the resistors) and the column surfaces.

Figure 3:
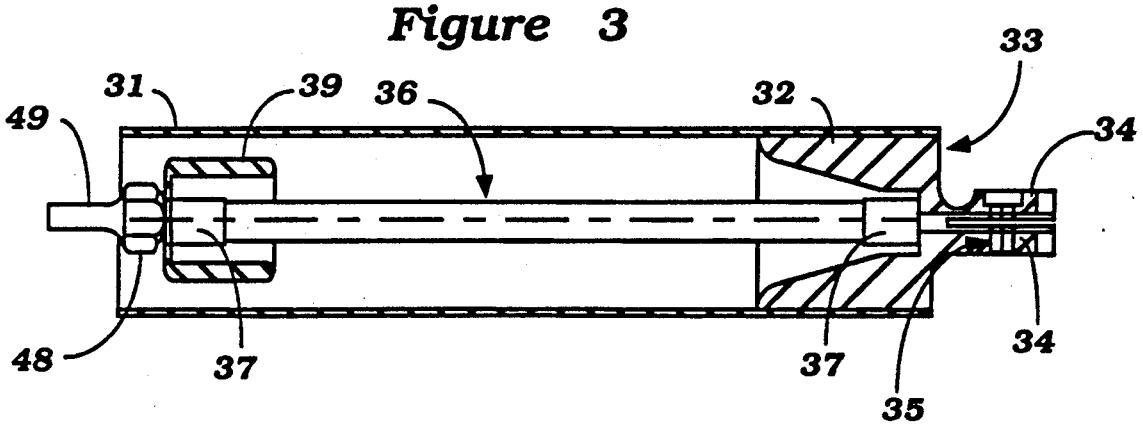
FIG. 3 is a cross-sectional view through a resistor of the present invention.
Figure 4:
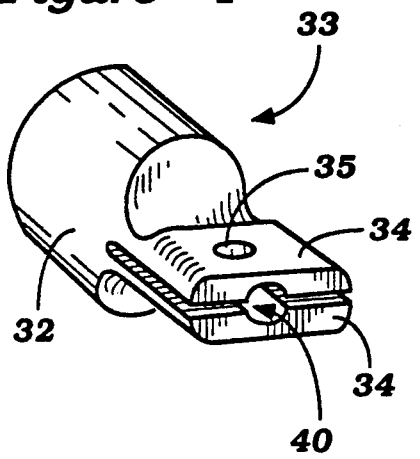
FIG. 4 is a perspective sketch of the clamp of the resistor illustrated in FIG. 3.

The construction of the resistor assembly of the present invention is illustrated in FIG. 3. A protective metal tube 31 (usually of stainless steel) is force fit on to the support region 32 of a metal clamp 33 (see also FIG. 4). The force fitting of the tube to the clamp causes the circumference of the tube to "stretch" by 0.05 to 0.10 mm. The clamp 33 also has two arms 34 which are spaced apart a distance approximately equal to the thickness of a metal disc 22. The clamp also has a threaded aperture 35 extending transversely through the arms 34, so that a clamping screw can be used to facilitate the clamping of the resistor to the edge of a metal disc 22.

Figure 5:
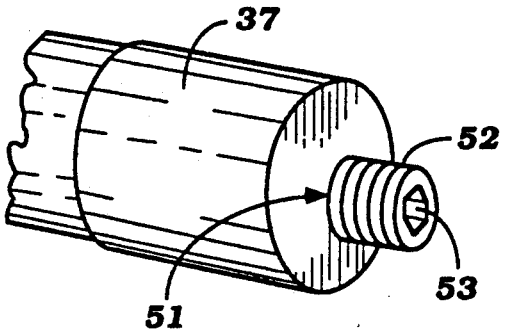
FIG. 5 is a perspective sketch (partly schematic) of the cap at each end of the resistive element of the resistor of the present invention.

A metal (usually brass) cap 37 is press-fit coaxially, and mechanically strongly, on to each end of an elongate resistive element 36, having a circular cross-section. As shown in FIG. 5, the closed end of each cylindrical metal cap 37 has a central threaded aperture 51 into which is screwed, and secured in position by an adhesive such as LOC-TITE (trade mark), an externally threaded stud 52. The stud 52 (which may be fabricated from a stainless steel grub screw with its nylon tip flattened) is provided with a cavity 53 having a hexagonal cross-section, to receive an Allen key. Grub screws having such Allen key sockets are commercially available. The presence of the Allen key socket enables torque to be applied to the metal cap without influencing the connection between the resistive material of the resistive element and the metal cap. Thus, when connecting the resistive element to the clamp 33, an Allen key is inserted through a clearance aperture 40 which passes through the clamp 33 from between the arms 34 to a tapped bore adapted to receive the threaded stud 52. The Allen key is used to tighten the connection of the brass cap 37 to the clamp 33, and thus mount the resistive element on the clamp, in a cantilevered manner, coaxially with the protective tube 31.

At the other end of the resistive element a cylindrical capacitive electrode 39 is securely mounted on the cap 37 using a hexagonal nut 48 which forms part of an RF connector 49. In assembling the combination of electrode, connector and cap, the hexagonal nut is tightened against the stud 52 of its associated cap 37 while the stud is held stationary by an Allen key inserted into the socket 53 through an aperture which extends through the connector 49.

Preferably the capacitive electrode 39 is of titanium, to minimise spark erosion and weight. It provides a spark gap with the protective metal tube 31, which reduces the electric field, and hence the stress, on the resistive element at the junction of the resistive element with the metal cap. In addition, during transient overvoltage conditions, the electrode 39 with couple current into the first few convolutions or turns of the resistive element, thus again reducing the electric stress.

Connections to the free end of the resistive element are achieved using loops of copper "pigtails" crimped or soldered to gold plated miniature banana plugs. The banana plugs fit into the sockets of the RF connectors 49, being either force-fitted into the sockets or soldered into the sockets for good electrical contact. Preferably the hexagonal nuts 48 and the connectors 49 are of aluminium, with gold plating.

Assemblies of 800 Megohm (with two per cent tolerance) resistors constructed in accordance with the present invention have been tested in the 14UD Pelletron accelerator of The Australian National University. Each resistor had the features shown in FIG. 3. The outer diameter of the protective tube 31 was 25 mm for the resistors used with the support columns of the accelerator and was 18 mm for resistors used in association with the accelerator tube.

In one test, a set of thirty-four resistors, each having a protective tube 31 of 18 mm outer diameter, was mounted with the resistors in pairs as shown in FIG. 2. Each resistor pair successfully withstood a voltage difference of 73 KV, without breakdown. There was no resistor to resistor sparking when the accelerator was used with the high voltage electrode at voltages of from 16.0 to 16.7 MV.

After this test, the assembly of thirty-four resistors was retained in the accelerator while it was used in the normal manner for over a year. During that use of the accelerator, the high voltage electrode was operated at voltages up to 15.5 MV.

The thirty-four test resistors were removed from the accelerator in March 1989 and the resistance of each resistor was measured at 5 KV and at 3 volts. The resistance of the resistors were all within the two per cent tolerance that had been specified originally.

A total of 3,044 resistors, constructed in accordance with the present invention, were installed in the Pelletron accelerator at the Australian National University, which has subsequently been operated normally, without any resistor breakdown.

Those skilled in this art will appreciate that a particular form of the invention has been illustrated and described above, and that variations of the illustrated embodiment can be made without departing from the present inventive concept.

We claim:

1. A resistor for use in high voltage dc applications comprises:

(a) a metal clamp, adapted to be clamped to the edge portion of a metallic disc or flange used in the high voltage dc application, said metal clamp having a support region of substantially circular cross-section;

(b) a cylindrical metal tube that has been force fitted onto the support region of said metal clamp said metal tube extending from the support region away from the clamping portion thereof;

(c) an elongate resistive element, each end of which is terminated by a metal cap which fits over the end of the resistive material of the resistive element and makes intimate electrical contact with said resistive material, each metal cap having a centrally mounted, externally threaded projection from the end thereof, the projection having an Allen key socket or the like formed centrally therein, one of said metal caps being securely screwed into a receptive threaded aperture in the centre of the support region of said clamp, whereby the resistive element projects from the support region coaxially with said cylindrical tube;

(d) a cylindrical capacitive electrode having an outer diameter less than the inner diameter of said cylindrical tube mounted on the projection from the end of the metal cap of the resistive element which is remote from said support region; said capacitive electrode being coaxial with said resistive element and said cylindrical tube and defining, with said cylindrical tube, a spark gap for said resistor; and (e) a connector also mounted on the end of said resistive element which is remote from said support region, said connector being mounted adjacent to said capacitive electrode.

2. A resistor as defined in claim 1, in which said clamp has a pair of generally flat arms extending parallel to the axis of said support region, said arms being separated by slot which has a width substantially equal to the thickness of said disc or flange, one of said arms having a threaded aperture extending therethrough in a direction perpendicular to said slot, whereby a clamping screw may be inserted into said threaded aperture in said arm, to clamp said arms to said disc or flange.

3. A resistor as defined in claim 2, including a channel extending through said slot and said support region along the axis of the support region, for receiving an Allen key to facilitate the screwing of the externally threaded projection of a metal cap of said resistive element into said receptive threaded aperture.

4. A resistor as defined in claim 1, in which said connector is formed as part of a nut having a channel therein through which an Allen key can pass, the end of said channel through the nut which is closest to said resistive element being threaded to receive the externally threaded projection of a metal cap of said resistive element.

5. A resistor as defined in claim 4, in which said nut secures said capacitive electrode to its associated metal cap of the resistive element.

6. A resistor as defined in claim 5, connected to a second resistor as defined in claim 5 by a length of a copper "pigtail", each end of said "pigtail" terminating in a respective plug, each plug being connected to a connector of one of said resistors, to form a series connected pair of resistors.

7. A series connected pair of resistors as defined in claim 6, the clamp of each resistor of the pair being clamped to a respective one of a pair of adjacent metallic discs of an electrostatic accelerator.

* * * * *